US006341697B1

(12) United States Patent
Miller et al.

(10) Patent No.: US 6,341,697 B1
(45) Date of Patent: Jan. 29, 2002

(54) SELECTIVE FLOTATION OF PHOSPHATE MINERALS WITH HYDROXAMATE COLLECTORS

(75) Inventors: Jan D. Miller; Xuming Wang; Minhua Li, all of Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 09/699,967

(22) Filed: Oct. 30, 2000

Related U.S. Application Data

(60) Provisional application No. 60/162,258, filed on Oct. 29, 1999.

(51) Int. Cl.[7] ..... B03D 1/01; B03D 1/008; B03D 1/02

(52) U.S. Cl. ..... 209/166; 252/61

(58) Field of Search ..... 209/166; 252/61

(56) References Cited

U.S. PATENT DOCUMENTS

| | | | | |
|---|---|---|---|---|
| 2,293,640 A | * | 8/1942 | Crago | |
| 3,779,380 A | * | 12/1973 | Bishop | |
| 4,629,556 A | | 12/1986 | Yoon et al. | 209/166 |

FOREIGN PATENT DOCUMENTS

| | | | |
|---|---|---|---|
| SU | 688235 | * | 9/1979 |
| SU | 839570 | * | 6/1981 |
| SU | 956022 | * | 9/1982 |
| SU | 1115807 | * | 9/1984 |

OTHER PUBLICATIONS

S. M. Assis, et al. "Utilisation of Hydroxamates in Minerals Froth Flotation" Minerals Engineering, vol. 9, No. 1, pp. 103–114, 1996, Elsevier Science Led., Great Britian.

* cited by examiner

*Primary Examiner*—Thomas M. Lithgow
(74) *Attorney, Agent, or Firm*—James L. Sonntag, Esq.

(57) ABSTRACT

A method is disclosed for separating phosphate minerals from a mineral mixture, particularly from high-dolomite containing phosphate ores. The method involves conditioning the mineral mixture by contacting in an aqueous in environment with a collector in an amount sufficient for promoting flotation of phosphate minerals. The collector is a hydroxamate compound of the formula;

wherein R is generally hydrophobic and chosen such that the collector has solubility or dispersion properties it can be distributed in the mineral mixture, typically an alkyl, aryl, or alkylaryl group having 6 to 18 carbon atoms. M is a cation, typically hydrogen, an alkali metal or an alkaline earth metal. Preferably, the collector also comprises an alcohol of the formula,

R'—OH wherein R' is generally hydrophobic and chosen such that the collector has solubility or dispersion properties so that it can be distributed in the mineral mixture, typically an alkyl, aryl, or alkylaryl group having 6 to 18 carbon atoms.

2 Claims, 8 Drawing Sheets

SELECTIVE FLOTATION OF PHOSPHATE MINERALS WITH HYDROXAMATE COLLECTORS

RELATED APPLICATIONS

This application is a continuation-in-part of United States Provisional Patent Application No. 60/162,258, filed Oct. 29, 1999.

STATEMENT REGARDING FEDERALLY SPONSORED RESEARCH OR DEVELOPMENT

This invention was supported in part by contract number DOE (DE-FG-03-93 ER14315) from the Department of Energy (DOE). The Government has certain rights in the invention.

FIELD OF THE INVENTION

This invention relates to separation of phosphate minerals from other minerals, particular from phosphate containing ores.

BACKGROUND OF THE INVENTION

World fertilizer production continues to be a crucial factor for the efficient growth of crops to feed the peoples of the earth. Phosphate is an essential ingredient of fertilizer, and the world production of phosphate rock is more than 147.1 million mt per annum as indicated in Table 1. It should be noted that the U.S. is the largest producer of phosphate rock with most of its 40-plus million mt per annum coming from the vast sedimentary deposits in central Florida. However as discussed at recent Engineering Foundation Conferences on Phosphate, December 1993 and 1998, Palm Coast, Fla., many technological problems must be solved if we are to continue to produce phosphate rock at our current rate of consumption. Unless these technological problems are solved, phosphate rock may be in short supply. The critical nature of this situation is clarified by Isaac Asimov, "We may be able to substitute nuclear power for coal power; and plastics for wood; and yeast for meat, and friendship for isolation-but for phosphorus there is neither substitute nor replacement."

One of the most important processing technologies which accounts for this significant production of phosphate is the process of froth flotation which is used exclusively around the world. The flotation process is based on appropriate surface chemistry control in order to selectively generate hydrophobic surfaces on certain mineral particles while maintaining the surfaces of other mineral particles in a hydrophilic state. The phosphate industry has relied on the flotation process since the 1950's and will continue to do so for decades to come.

TABLE 1

Phosphate Production in 1997

| Country | Millions of Tons |
|---|---|
| USA | 42.3 |
| USSR/CIS | 12.0 |
| Morocco | 22.3 |
| China | 31.3 |

TABLE 1-continued

Phosphate Production in 1997

| Country | Millions of Tons |
|---|---|
| Tunisia | 7.2 |
| Other (Israel, Jordan, Egypt, Saudi Arabia, Brazil, India, Australia, S. Africa) | 32.0 |
| TOTAL | 147.1 |

A significant problem which now faces the phosphate industry worldwide is the selective separation of phosphate minerals from carbonate minerals, particularly dolomite, by froth flotation. The Florida phosphate industry is no exception to this problem, and future production from the phosphate deposits of central Florida will require the development of new flotation technology for improved separation efficiency. Typical specifications of the phosphate rock concentrate for the production of fertilizer are:

<1% MgO

>30% $P_2O_5$

<4% $SiO_2$

Traditionally these specifications have been relatively easy to meet because the run-of-mine phosphate rock has been mostly siliceous rock rather than calcereous or dolomitic rock. The current state-of-the-art has been discussed in the literature and at the Engineering Foundation Conferences on Phosphate, December 1993 and 1998, Palm Coast, Fla. Now, it is evident that the siliceous resources will soon be exhausted, and only the difficult-to-separate, carbonate-bearing rock will remain as our country's major phosphate resource. Efforts have been made for some time to treat such carbonate-bearing rock, particularly the dolomitic phosphate reserves of Florida.

Froth flotation for the separation of phosphate minerals from other gangue minerals has been practiced by fatty acid flotation with pine oil as frother since as early as 1928. Many flotation strategies for the processing and concentration of phosphate ores have been developed since then. The conventional phosphate flotation process for sedimentary deposits of central Florida is the "double float" process, viz. anionic flotation of phosphate minerals at alkaline pH, followed by cationic "reverse" flotation of silica from the initial phosphate concentrate at neutral or acidic conditions. The Florida phosphate industry, with few exceptions, still uses this standard method.

Summary of Phosphate Flotation Processes

Flotation is the most widely used method for the treatment of phosphate rock. The flowsheet design depends on the type of ore (endogenic or sedimentary deposit) and the nature of impurities (silica or carbonate) to be removed. Phosphate flotation strategies can be classified as follows:

Direct Flotation of Phosphate

The phosphate minerals are floated directly using carboxylate (fatty acids and the corresponding soaps) collectors, often co-added with hydrocarbon supplements (such as kerosene, fuel oil, etc), and appropriate reagents for gangue depression. This process is very successful for endogenic siliceous phosphate deposits. In this process the advantages are a relatively simple flowsheet, and low cost.

Reverse Flotation of Carbonate Minerals

Dolonite and other carbonate minerals are floated using carboxylate collectors under slightly acid conditions with phosphoric acid added for the depression of phosphate minerals. If the feed contains a significant amount of silica a final concentrate cannot be obtained with this strategy alone.

Double Float Flotation Processes

There are two flotation processes which fall in this category. One is the Direct-Reverse flotation process. In this process the first stage is designed to float as much phosphate mineral as is possible using carboxylate collector. In this stage some of the silica and/or carbonate gangue is rejected. The second stage is referred to as reverse flotation. In this stage only as much silica or carbonate mineral is floated from the initial phosphate concentrate as is required to meet the final desired product specifications. For example this "double float" process is widely used in central Florida phosphate industry, viz. the anionic flotation of phosphates at pH8–9.5, followed by cationic flotation of quartz from the acid-scrubbed rougher concentrate at pH 6–7.5.

Another process that falls in this category is the Reverse-Direct flotation process. In the first stage the carbonate or silica gangue mineral is floated and then the phosphate flotation is carried out. When the feed contains two types of gangue mineral (silica and carbonate) this double stage strategy may not be efficient.

Phosphate flotation efficiency needs to be improved in several ways. Technology needs to be developed to eliminate the double flotation processes, to improve the flotation efficiency for both coarse and fine phosphate, and to solve the dolomite problem. A very important factor in flotation technology is the use of appropriate reagents. Collectors and other reagents need to be developed to improve coarse particle flotation and to achieve selectivity with respect to carbonate minerals, particularly dolomite. The development of highly selective collectors, which are specific to the surface structure of a particular mineral, is essential for the exploitation of relatively more difficult-to-process ore deposits, particularly for the separation of semi-soluble minerals having a common cation. The difficulty in the separation of phosphate from dolomite is probably due to the fact that both minerals have the same cation $Ca^{2+}$, and similarly sized anions, $PO_4^{3-}$ and $CO_3^{2-}$.

The major dolomite problem associated with the future reserves in central Florida is found with the pebble fraction (~6% MgO). The development of a satisfactory processing strategy will probably involve grinding and classification followed by flotation or some other method to separate the dolomite from the phosphate. A number of flotation technologies have been under development for the Florida carbonate-bearing phosphate rock, and most under current study involve the anionic flotation of carbonate minerals from an acid suspension. These include, USBM—pH 6.0 depression of phosphate with hydrofluosilic acid.

TVA Diphosphonic Acid—pH 6.5 phosphate depression with ethylidene hydroxydiphosphonic acid.

Aluininum Sulfate/Tartrate—pH 7.5 to 8.2 phosphate depression with $Al_2(SO_4)_3$/Na tartate.

Sulfuric Acid—pH 5.0 to 5.5 phosphate depression simply by sulfuric acid, fast conditioning and flotation time in order to maintain pH. Even better flotation separation efficiencies are obtained at pH 3.5 to 4.5.

Phosphoric Acid—pH 5.0 to 5.5 phosphate depression by phosphoric acid.

IMC Anionic—pH 5.0 to 6.0 flotation of carbonate with sulfonated fatty acid, phosphate depression with sodium tripoly phosphate.

In all of these cases, the process strategy involves flotation of carbonate minerals from the phosphate minerals in an acid circuit with anionic collectors. However, the separation efficiency has been limited by the control of pH and the effective depression of apatite or other phosphate minerals such as collophane and francolite. At this point, a satisfactory process strategy has not been established, and the dolomitic resources cannot be processed economically.

Hydroxamate collectors have had limited use in the industry for flotation separations. Examples include the separation of colored impurities from kaolin clay, the recovery of copper oxides from ores, and the selective flotation of iron oxide from gangue minerals. All of these separations involve separation based upon specific hydroxamate adsorption at metallic cationic sites of the minerals to be floated, and it is believed that the collectors function by a selective interaction with these cations of the mineral's lattice. Hydroxamate collectors have not been found in the prior-art to be effective for separations of minerals composed of alkaline earth cations. Specifically, there is no indication or expectation in the prior-art that hydroxamates would be effective for the flotation of phosphate minerals, such as apatite, collophanite, and francolite.

Objects of the Invention

It is, therefore, an object of the invention to provide an effective, inexpensive, method for separating phosphates from ores.

Another object of the invention is a method of separating phosphate minerals from high-content dolomite phosphate ores.

Further objects of the invention will become evident in the description below.

BRIEF SUMMARY OF THE INVENTION

In the present invention hydoxamates are used as selective collectors for the flotation separation of phosphate minerals from dolomite. Although hydroxamates have been used for more than twenty years as flotation collectors, their use for phosphate flotation has been ignored since phosphate flotation involves the flotation of calcium phosphate minerals and hydroxamates are not expected to adsorb at calcium surface sites. For this reason, the prior-art of flotation would teach one of ordinary skill away from the use of hydroxamates for the flotation of phosphate rock.

In general, alcoholic solutions of alkyl hydroxamates and other hydroxamates are added to a particular suspension of phosphate ore and after aeration the phosphate minerals are floated from the gangue minerals, such as dolomite. It is understood that the general use of the term hydroxamates includes the acid form, allylhydoxamic acid.

The present invention comprises a method for separating phosphate minerals from a mineral mixture, such as a phosphate ore. The mineral mixture is conditioned by contacting in an aqueous in environment with a hydroxamate collector in an amount sufficient for promoting flotation of phosphate minerals. The mixture is then subject to flotation conditions to float the phosphate minerals and separate them from the gangue minerals, such as quartz, calcite, and dolomite. The collector comprises a hydroxamate compound of the formula;

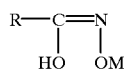

wherein R is generally hydrophobic and chosen so that the collector has solubility or dispersion properties such that it can be distributed in the mineral mixture. M is a cation, such as hydrogen, an alkali metal, or an alkaline earth metal, and is chosen such that the collector has solubility or dispersion properties such that it can be distributed in the mineral mixture. The collector is distributed in the mineral mixture by any suitable method. The conditioning in the present invention can be accomplished using traditional conditioning systems, and the process of the invention can be used directly in existing plants with little or no equipment modification.

In a preferred embodiment of the invention, the collector also includes in addition to the hydroxamate an alcohol of the formula;

R'—OH where R' is the same or different from the R of the hydroxamate, and is generally hydrophobic and chosen such that the collector has solubility or dispersion properties so it can be distributed in the mineral mixture.

Hydroxamate and alcohol compounds having suitable properties for use in the invention are believed to include those where the R or R' is an alkyl, aryl, or alkylaryl group having 6 to 18 carbon atoms, and M is typically hydrogen, an alkali metal or an alkaline earth metal.

It should be noted, that hydroxamic acid can exist in two forms, i.e., the N-acyl derivative (I) or the O-acyl derivative (II), as shown by the following structures;

(I)

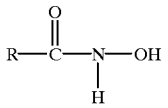

(II)

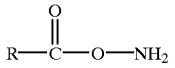

while the N-acyl form is the most common. It can exist in either of two tautermeric forms:

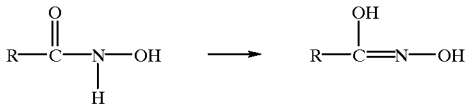

The formula used herein and in the claims, shows the N-acyl hydroxamate form, but it is understood that O-acyl form, as well as the tautermeric forms of N-ocyl are contemplated by the invention and included within the general definition recited in the claims.

Other chemicals and reagents, such as dispersants and modifiers, may optionally be added to the mineral mixture. These may be desired with certain mineral mixtures to, for example, aid dispersion or modify the pH. Examples include sodium carbonate, and sodium silicate.

The present invention is particularly useful for separating phosphate minerals from dolomite, calcite, quartz and other common gangue minerals. The separation efficiency of the hydroxamate collector is unexpected because previous flotation separations using hydroxamates have been based upon adsorption at metallic cationic sites on the mineral surface, for example, the flotation of iron minerals from kaolin. Since dolomite and phosphate minerals usually have the same cation, calcium, it would be expected that any differentiation would be at most insignificant, as demonstrated in the literature, for example in S. M. Assis, et al. "Utilisation of Hydoxamates in Minerals Froth Flotation" *Minerals Engineering*, Vol. 9, No. 1, pp. 103–114, 1996.

However, unexpectedly in the present invention, differentiation is achieved. Not only is the magnitude of the differentiation unexpected, but its very existence is unexpected. Separations with hydroxamate in the prior-art have involved hydroxamate adsorption at cationic sites of heavy metal minerals, particularly transition-metal cations and rare-earth metal cations. These from very stable complexes with hydroxamate, which makes hydroxamate an effective flotation agent for such minerals. The affinity of hydroxamate for the calcium cationic, in comparison is much weaker, and complexes of hydroxamate with calcium are much less stable. This is evident by consideration of the stability constants shown in Table 2, which shows that the stability constant (K) for the calcium hydroxamate is orders of magnitude lower than any of the other metal cations listed. Thus, it is unexpected that hydroxamates, which form such weak calcium complexes could be effective in selectively floating a calcium-cation phosphate mineral

TABLE 2

Stability constants for metal hydroxamates at 20° C.

| Cation | logK | Cation | logK |
|---|---|---|---|
| $H^+$ | 9.35 | $Gd^{3+}$ | 6.10 |
| $Ca^{2+}$ | 2.4 | $Dy^{3+}$ | 6.52 |
| $Fe^{2+}$ | 4.8 | $Yb^{3+}$ | 6.61 |
| $La^{3+}$ | 5.16 | $Al^{3+}$ | 7.95 |
| $Ce^{3+}$ | 5.45 | $Fe^{3+}$ | 11.42 |
| $Sm^{3+}$ | 5.96 | | |

[1], [2] [3]

[1] Pradip & Fuerstenau, D. W. Mineral flotation with hydroxamate collector. *Reagents in the Mineral Industry*, (M. J. Jones & R. Oblatt eds), London, UK, 161(1984)

[2] Schwarzenbach G. and Schwarzenbach K. Hydroxamatekoplexe I. Die Stabilitat der Eiser (III)—Komplexe einfacher Hydroxamsauren und der Ferrioxamins B. *Helv. Chim. Acta,* 46, 1963, 1390–408

[3] KB Quast, Flotation of hematite using hydroxamates as collector, *Reagents in the Mineral Industry*, (M. J. Jones & R. Oblatt eds), London, UK, 161(1984)

The stability of hydroxamate complexes arises due to chelation phenomena as indicated by the following structure for a divalent metal cation M'.

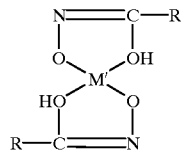

It is evident that the calcium complex is the least stable complex and in this regard it is unexpected that hydroxamate serves so efficiently and with such great selectivity as a collector for phosphate minerals. (See J. W. Munson, Chemistry and Biologic Activity of Hydroxamic Acids An Overview, *Chemistry and Biology of Hydromamic Acids*, Editor: Horst Kehl, Kirksville, Missouri, 1982.)

By practice of the present invention it is possible to solve the dolomitic phosphate problem as well as provide new technology for the processing of the traditional phosphate resources. The significance of this discovery is revealed by the flotation data presented in FIG. 1. It is evident that excellent selectivity is possible with hydroxamates. Specifically apatite recovery of more than 95% is possible by single-stage flotation with a collector addition of 250 g/ton, whereas flotation of dolomite and quartz is not possible even at hydroxamate additions of up to 100 g/ton.

Potential Benefits

The successful development of the new flotation technology for dolomitic/calcitic phosphate ores will allow for the utilization of many additional phosphate resources. It is estimated that almost 20 million tons of phosphate rock were produced in the U.S. by froth flotation in 1997 and reagent demand was substantial, corresponding to almost 50 million dollars. During the next decade it is expected that a significant portion of this production will have to come from dolomitic/calcitic phosphate ore. Already such ores are processed rather inefficiently in Utah and Idaho. A similar situation exists with the North African and Middle Eastern deposits. It is expected that the flotation chemistry of the present invention will provide for a more efficient separation.

DETAILED DESCRIPTION OF THE INVENTION

EXAMPLE A

Technique

Figure 1:
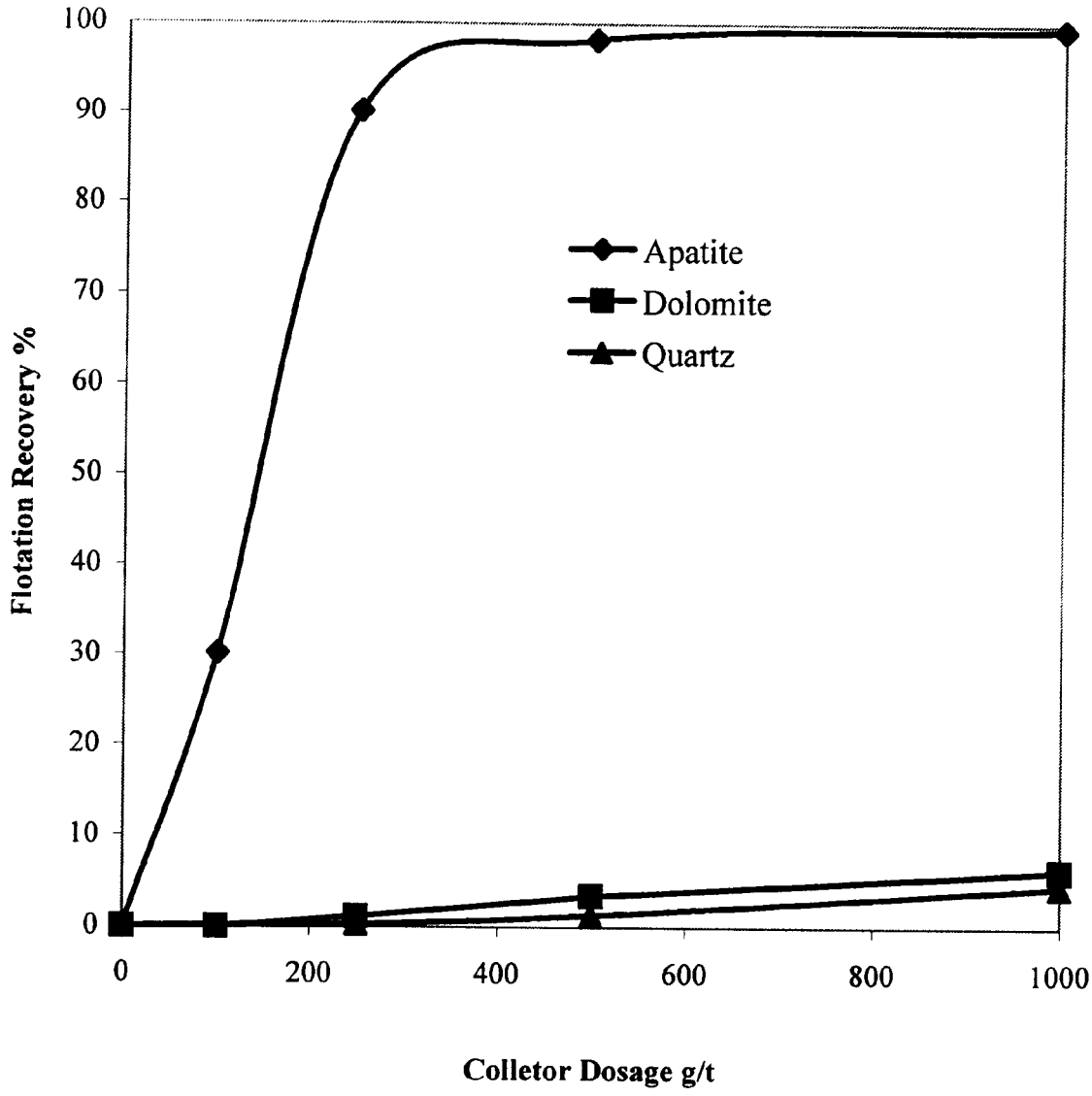
FIG. 1 is a graph that shows the flotation recovery of apatite, dolomite and quartz as a function of the alkylhydroxamic acid dosage at a natural pH (pH 6.5), with tap water.

Pure Minerals (a) Natural single crystals of yellow apatite, from Durango, Mexico were used. The X-ray diffraction patterns revealed that these transparent apatite crystals were fluorapatite $[Ca_{10}(PO_4)_6F_2]$ of a high quality. The crystals (approximately 5×20 mm) were crushed and ground in a ceramic mortar and screened by standard microtesting sieves. The−35+100 mesh size fraction was taken for flotation.

(b) A polycrystalline francolite sample was provided by Florida Institute of Phosphate Research (FIPR), Bartow, Fla. The sample which contains 32.41% $P_2O_5$, 4.74% Insol., 0.4% MgO, and 46.11% CaO can be identified as carbonateflouorapatite $[Ca_{10-a-b}Na_{2a}Mg_b(PO_4)_{6-x}(CO_3)_xF_xF_2]$. The material was sized and the −35+100 mesh particle size fraction was taken for testing.

(c) A polycrystalline dolomite was provided by FIPR, Bartow, Fla. The sample which contains 1.63% $P_2O_5$, 4.43% Insol., 17.60% MgO, and 29.95% CaO was sized and the −35+100 mesh size fraction was taken for flotation, (d) A high quality quartz sample (20×30 mesh) was obtained from US Silica.

Phosphate Ore

US Florida phosphate ore: IMC-Agrico Company, Central Florida, provided two of the phosphate flotation samples. One sample was fine phosphate flotation feed (35×100 mesh, about 7.2% $P_2O_5$) and the other sample was coarse phosphate flotation feed (16×25 mesh, about 13% $P_2O_5$).

US western phosphate ore: Vemal Phosphate Rock Mill, Utah provided the phosphate sample (rougher phosphate flotation feed, 20×200 mesh, about 26%$P_{25}$).

Chemicals (a) Fatty acid ($C_{5-17}H_{27-35}COOH$, industrial mixture), provided by Westvaco, was prepared as a 1% in water dispersion for use in flotation testing.

(b) Fuel Oil, #5 commercial fuel oil, industrial mixture, was provided by International Petroleum and used without dilution.

(c) Sodium alkyl sulfate ($NaC_{16-18}H_{33-37}SO_4$), Flotinor S72, manufactured by Clariant, Brazil, was prepared as a 3% solution.

(d) Alkylhydroxamic acid solution, AERO 6493,a commercial reagent, provided by CYTEC Industrial Inc. was used. The major components of AERO 6493 are 5–6% caprylic acid ($C_7H_{15}.COOH$), 60% dodecyl alcohol ($C_{11-14}$ isomers), and 35% alkylhydroxamic acid (R—C(O)NHOH).

(e) Alkylhydroxamic acid crystals (f) Alcohols of different chain lengths (g) Other chemicals Solutions of sodium hydroxide (NaOH), and hydrochloric acid (HCl), analytical grade, supplied by Mallinckrodt, were used for pH adjustment. Other reagents and collectors as mentioned in the detailed description were provided at the FIPR Laboratories in Bartow, Fla.

Microflotation Experimental Procedures

The flotation experiments were conducted with a 150 cc Hallimond tube in order to determine the flotation response with selected collectors. A sample (1 gram) of mineral particles was conditioned at 50% solids for 2 min. in a solution containing collector at the desired concentration and pH. The suspension was then diluted and the flotation was carried out for at least 2 minutes at a constant air flowrate of about 35 ml/min. The floated and nonfloated fractions were filtered, dried and weighed in order to determine the flotation recovery of the mineral under consideration. A magnetic stirring bar was used in all experiments to produce mixing and to increase the dispersion of the air.

Microflotation of Single Mineral Samples

Flotation with Alkylhydroxamic Acid

FIG. 1 shows the flotation recovery of single minerals, apatite crystal and dolomite and quartz as a function of the alkylhydroxamic acid dosage at pH 6.5.

Figure 2:
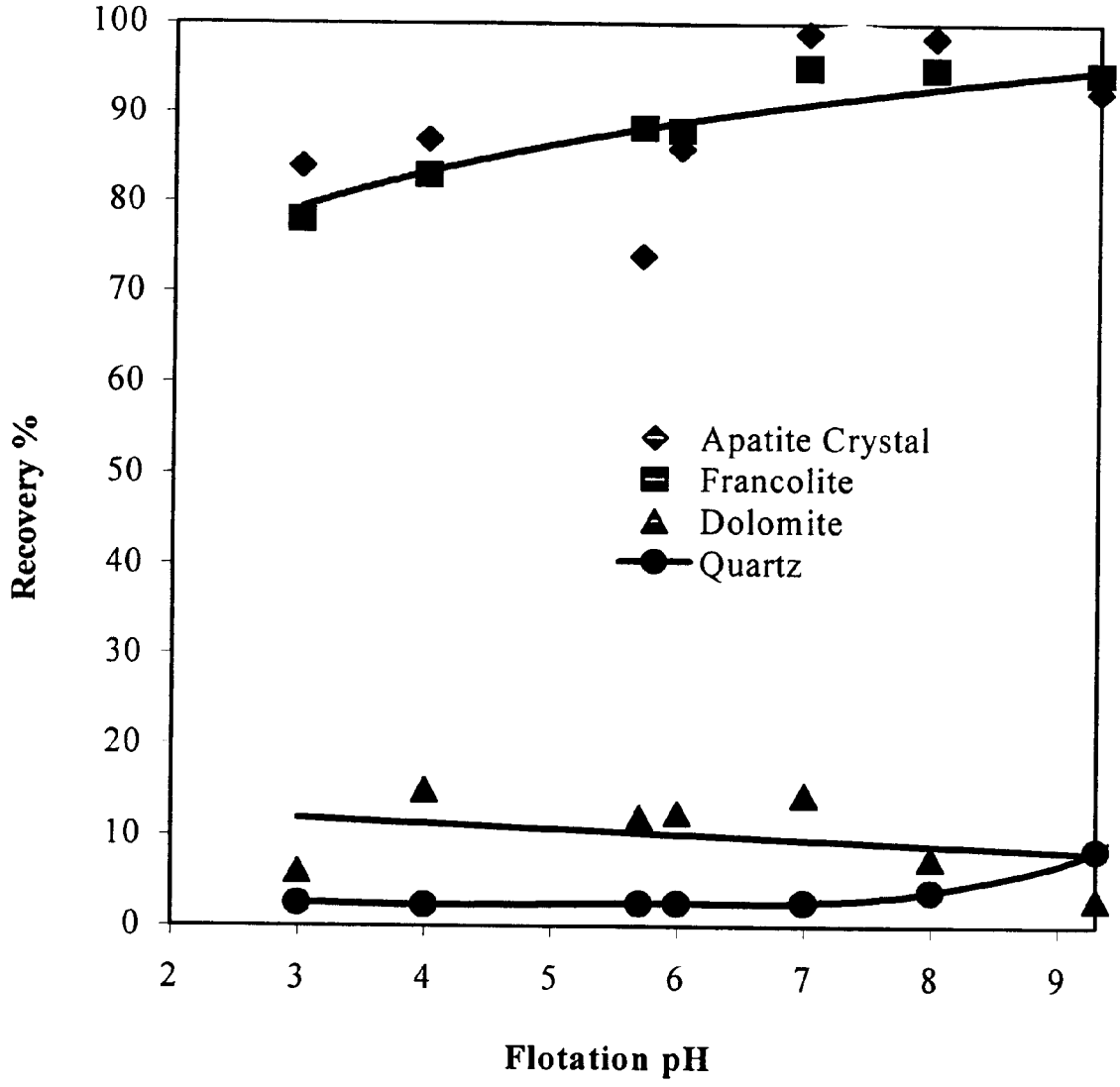
FIG. 2 is a graph that shows the flotation recovery of phosphate minerals, dolomite, and quartz as a function of pH with the addition of 2400 g/t allylhydroxamic acid, with distilled water.

FIG. 2 shows the flotation recovery of single minerals, apatite crystal, polycrystalline francolite, dolomite and quartz as a function of pH with the addition of 2400 g/t alkylhydroxamic acid.

It is evident that good selectivity for the flotation of phosphate minerals (apatite and francolite) from dolomite and quartz can be achieved with the alkylhydroxamic acid collector. It seems that at least 500 g/ton will be required to achieve flotation of the phosphate minerals with this particular hydroxamic acid collector and that the pH should be from pH 5 to pH 10.

Flotation with Fatty Acid and Fuel Oil

Figure 3:
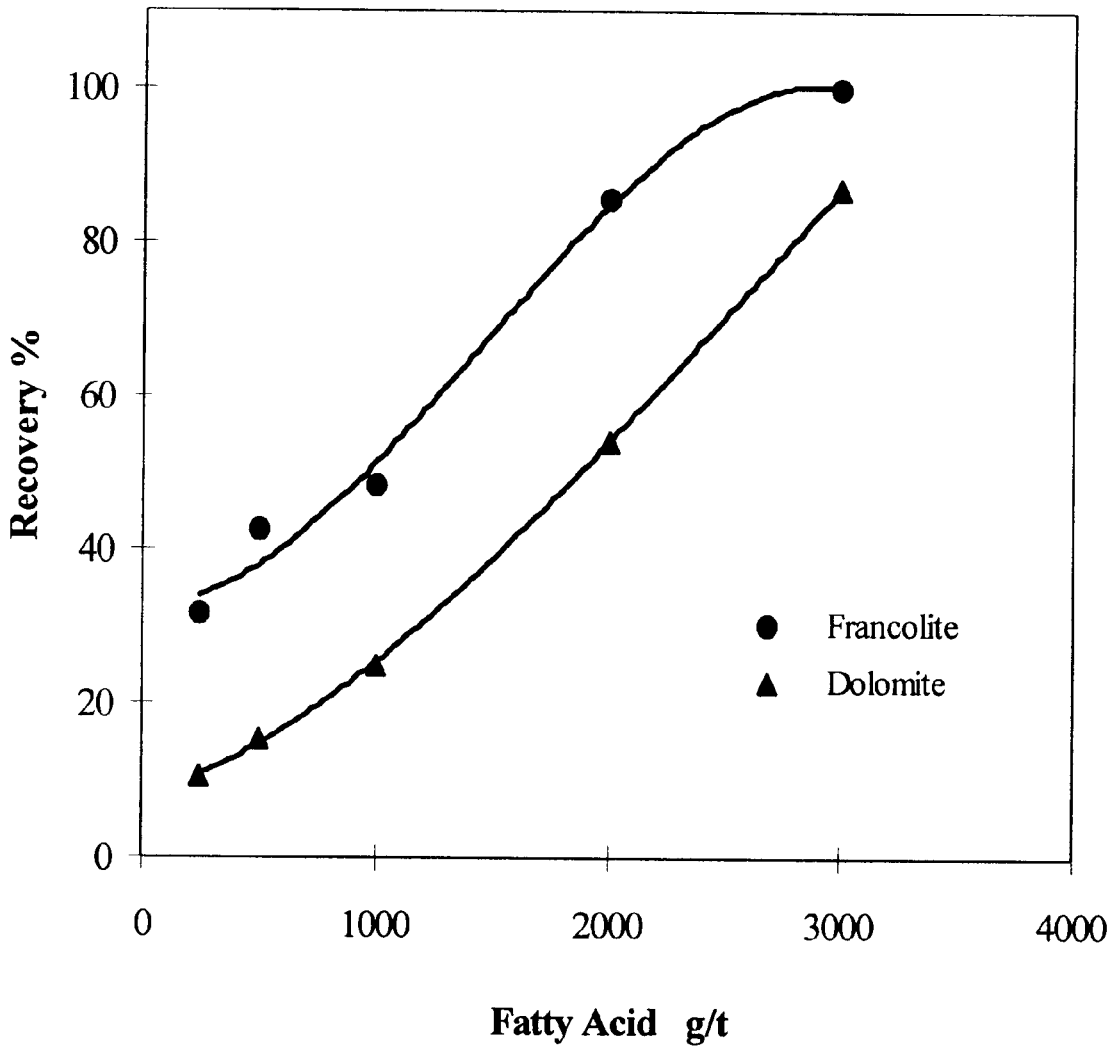
FIG. 3 is a graph that shows the flotation recovery of francolite and dolomite, as a function of fatty acid dosage at pH 6.5, with tap water.

FIG. 3 shows the flotation response of single mineral samples, polycrystalline francolite and dolomite, as a function of fatty acid dosage at pH 6.5.

Review of the experimental results presented in FIG. 3 reveals that the flotation separation of phosphate minerals from dolomite is nonselective with the fatty acid/fuel oil collector, regardless of collector addition.

Flotation With Alkyl Sulfate

Figure 4:
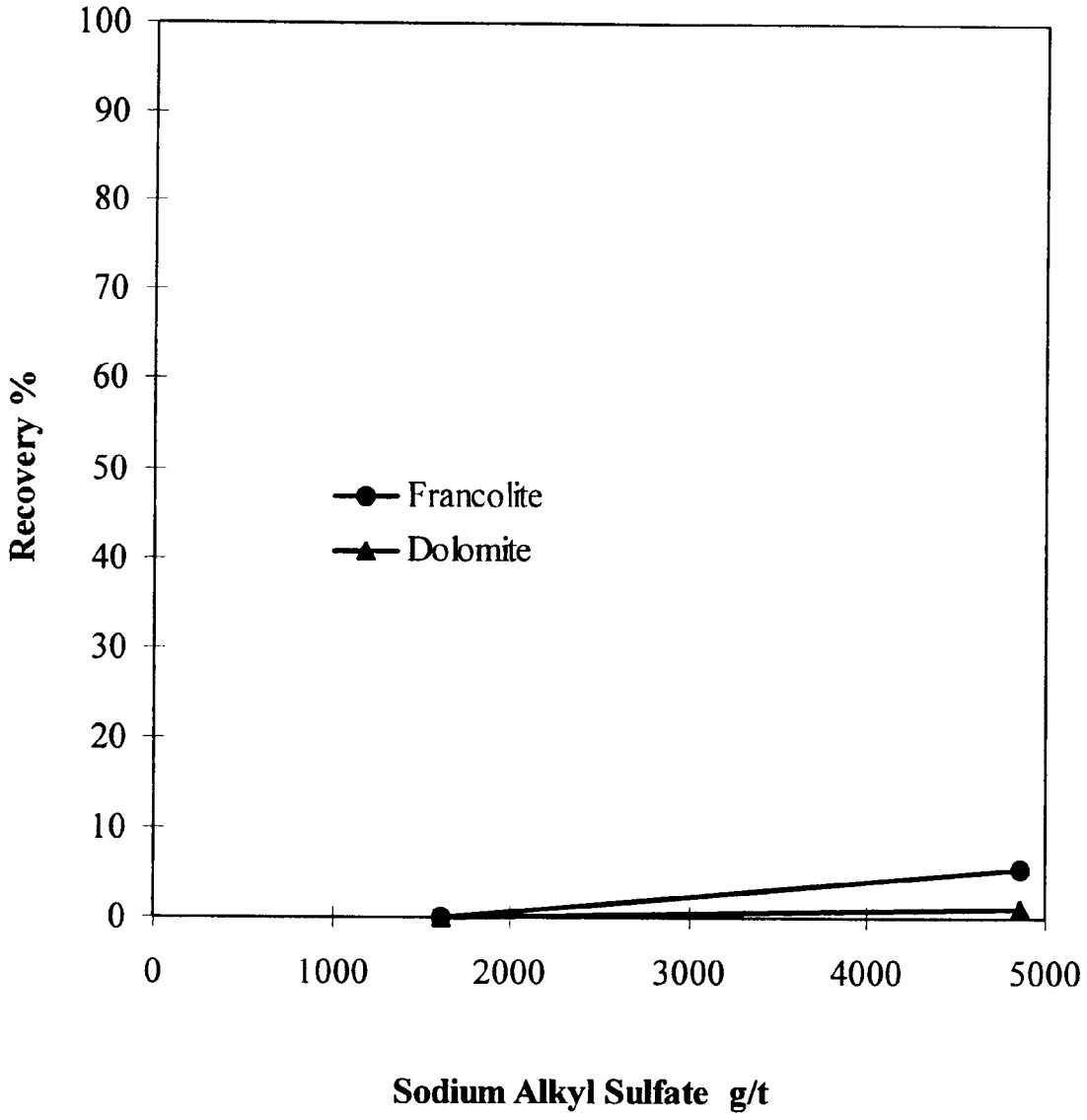
FIG. 4 is a graph that shows the flotation recovery of francolite and dolomite, as a function of alkyl sulfate dosage at pH 10.2, with distilled water.

FIG. 4 shows the flotation response of single mineral samples, polycrystalline francolite and dolomite, as a function of alkyl sulfate dosage at pH 10.2.

Figure 5:
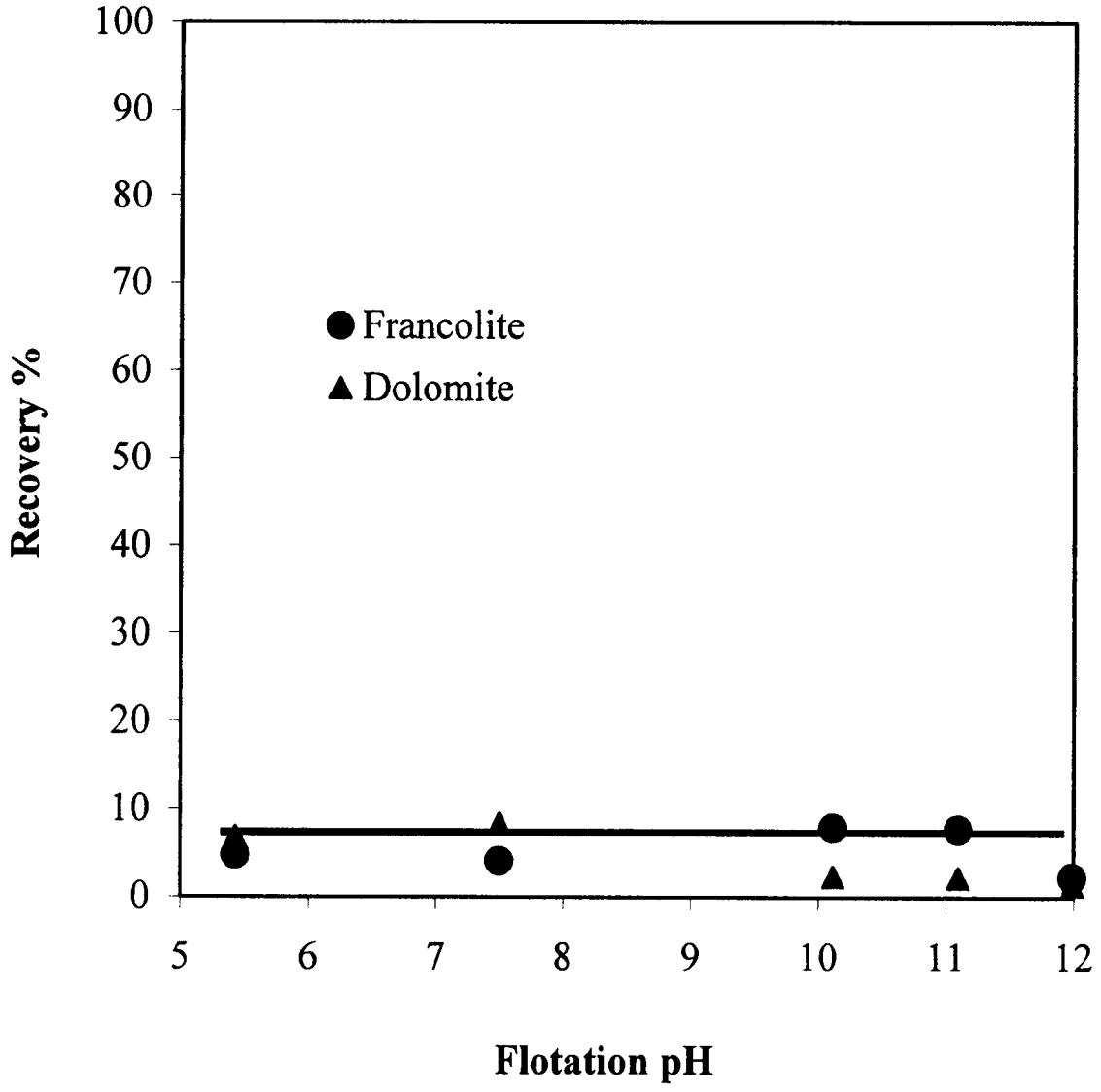
FIG. 5 is a graph that shows the flotation recovery of francolite and dolomite, as a function of pH with an addition of 8100 g/t alkyl sulfate, with distilled water.

FIG. 5 shows the flotation response of single mineral samples, polycrystalline francolite and dolomite, as a function of pH with an addition of 8100 g/t alkyl sulfate.

As can be seen from FIGS. 4 and 5 neither flotation of phosphate minerals nor flotation of dolomite could be achieved with an alkyl sulfate collector even at high reagent additions and various values of pH. Clearly this alkyl sulfate will not be suitable for the flotation recovery of phosphate minerals.

Batch Flotation of Phosphate Ore

US Florida Phosphate Flotation

The United States contributes over 25–30% of the world's phosphate production, and about 70% of the US production comes from the processing of sedimentary deposits in Central Florida.

The current processing is that the feed is conditioned at 70% solids with fatty acid and fuel oil at alkaline pH. After conditioning, the phosphate minerals are concentrated by flotation in a bank of flotation cells. The flotation concentrate is further upgraded by reverse flotation with amine to remove the entrained quartz particles after being scrubbed by acid to remove the adsorbed fatty acid and fuel oil. Since size reduction consumes a great amount of energy it is always desired to separate phosphate from gangue minerals with minimum size reduction whenever it is possible. However, difficulties are often encountered with coarse phosphate flotation. The following results are from the flotation of Florida coarse phosphate feed (16×35 mesh) using alkylhydroxamic acid as collector.

TABLE 3

Results from Single Stage Flotation of Coarse Phosphate Feed from Florida with Alkylhydroxamic Acid as Collector.

| Test No. | Product | Wt % | $P_2O_5$ % | $P_2O_5$ Recovery % |
|---|---|---|---|---|
| 1 | Concentrate | 45.64 | 31.56 | 94.44 |
| | Tailing | 54.36 | 1.56 | 5.56 |
| | Feed | 100.00 | 15.25 | 100.00 |
| 2 | Concentrate | 40.25 | 29.67 | 95.56 |
| | Tailing | 59.75 | 0.93 | 4.44 |
| | Feed | 100.00 | 12.50 | 100.00 |

Flotation was conducted in a 1 liter Denver flotation cell. The phosphate feed was conditioned at 75% solids for 3–4 minutes with alkylhydroxamic acid as collector at a dosage 800–900 g/ton. After conditioning the slurry was transfer to a 1 liter Denver flotation cell and diluted to 20–25% solids. Then air was introduced and flotation initiated. The flotation time was about 2–3 minutes. The flotation pH was the natural pH (pH =7.5).

The results in Table 3 indicate that a high flotation efficiency is obtained with alkylhydroxamic acid as collector. An excellent product (concentrate) is achieved with only one reagent in a single stage. The phosphate recovery reached 95% with a grade of 31% $P_2O_5$. Conventional plant practice in Central Florida with fatty acid/fuel oil collector (1,200 g/t) results in only 75–80% recovery at 31% $P_2O_5$ after many flotation stages in two different flotation circuits.

Shown in Table 4 are the results for the flotation of fine flotation feed from Florida (35×150 mesh). The procedure was the same as that used for the flotation of coarse feed.

TABLE 4

The Results from Single Stage Flotation of Fine Phosphate Feed from Florida with Alkylhydroxamic Acid as Collector.

| Test No. | Product | Wt. % | $P_2O_5$ % | $P_2O_5$ Recovery % |
|---|---|---|---|---|
| 1 | Concentrate | 20.46 | 28.82 | 76.38 |
| | Tailing | 79.54 | 2.30 | 23.62 |
| | Feed | 100.00 | 7.72 | 100.00 |
| 2 | Concentrate | 23.81 | 26.22 | 82.69 |
| | Tailing | 76.19 | 1.71 | 17.31 |
| | Feed | 100.00 | 7.55 | 100.00 |

Although the results in the case of the fine flotation feed from Florida are not as good as the results for the coarse flotation feed from Florida, the separation efficiency with alkylhydroxamic acid collector is still very good. For example, conventional plant practice in Central Florida with fatty acid/fuel oil collector and water glass as depressant results in 80–85% recovery at 20–25% $P_2O_5$ after many stages of flotation.

US Western Phosphate Flotation

The western phosphate deposits of the US cover much of the area from northeastern Utah, through eastern Idaho, and southwestern Montana. Several phosphate plants are now in operation throughout this area. The sample for this study is from Vernal Phosphate Rock Mill, Utah. The ore minerals have been identified as collophane, ahllite and francolite, all carbonate-bearing apatite minerals.

In the existing plant, the slurry, after crushing and grinding, is pumped to the primary desliming circuit to remove the slime (−200 mesh) using a hydrocyclone. The underflow from the hydrocyclone then passes through Linatex hydrosizers for further removal of slimes. The underflow (20×200 mesh) from the hydrosizer is conditioned at 70% solids with following reagents.

Hercules PAMAK, Fatty Acid

Stepan B-120, D-40, Petroleum Sulfonates

Diesel Fuel, #2 Fuel oil

Nalco 9743 Frother

After conditioning the slurry is discharged to the rougher flotation circuit. The rougher concentrate is cleaned in a cleaner flotation circuit. The tailing from rougher flotation reports to scavenger flotation circuit as scavenger feed. The scavenger concentrate is then sent to the carbonate flotation circuit. The following results are from the flotation of Vernal phosphate with alkylhydroxamic acid as collector. The procedure used was the same as that used in the flotation of US Florida phosphate samples.

TABLE 5

Results from Single Stage Flotation of Vernal Phosphate Flotation Feed with Alkylhydroxamic Acid.

| Test No. | Product | Wt. % | $P_2O_5$ % | MgO % | $P_2O_5$ Recovery % |
|---|---|---|---|---|---|
| 1 | Concentrate | 70.88 | 32.26 | 0.28 | 85.74 |
| | Tailing | 29.12 | 13.08 | 0.94 | 14.26 |
| | Feed | 100.00 | 26.67 | 0.47 | 100.00 |
| 2 | Concentrate | 76.23 | 29.96 | 0.36 | 87.81 |
| | Tailing | 23.77 | 13.36 | 0.84 | 12.19 |
| | Feed | 100.00 | 26.01 | 0.47 | 100.00 |

It is evident from the single stage flotation results presented in Table 5 that a high quality phosphate concentrate (>32% $P_2O_5$ and containing less than 0.3% MgO) can be made with alkylhydroxamic acid collector at more than 85% recovery from the flotation rougher feed of the Vernal plant. Typical plant practice using the conventional reagent schedule and involving multiple stages results in a concentrate containing 31.5% $P_2O_5$ at a recovery of ~75%. The superiority of the alkylhydroxamic acid collector is quite evident.

Summary

1. It is clear that the alkylhydroxamic acid collector has significant selectivity for the flotation of phosphate minerals from dolomite and quartz. The floatability of both apatite single crystals and polycrystalline francolite was much greater than that of dolomite and quartz when alkylhydroxamic acid was used as collector. Similar selectivity was found in the flotation of mineral mixtures with alkylhydroxamic acid. Excellent separation of phosphate minerals from both dolomite and quartz can be achieved. Such a single stage separation is not possible with other collectors such as common fatty acids and alkyl sulfates.

2. With the alkylhydroxamic acid used, the effectiveness of phosphate flotation from dolomite is essentially independent of pulp pH. This conclusion was tested and verified by replicate experiments and with different types of phosphate minerals.

3. Based on these results, it appears that the amount of alkylhydroxamic acid required for selective flotation will be 500–800 g/t, provided that conditioning is done properly at a high solids concentration (between about 70 and 75% solids by weight).

4. The significant difference between phosphate and dolomite flotation suggests that alkylhydroxamic acid may become the reagent of choice for the flotation of carbonate-bearing phosphate rock.

EXAMPLE B

Results from Preliminary Testing Program

Plant water, flotation feed samples (fine flotation feed and coarse flotation feed) were obtained from IMC-Agrico's Four Corners Plant for experiments at the University of Utah, items 1 and 2. Independent evaluation of the hydroxamate collector, item 3, was accomplished at FIPR laboratories.

Hydroxamte Collector with Plant Water at the University of Utah

Results from comparison tests using tap water and plant water with the hydroxamate collector are presented for coarse feed in Table 6 and for fine feed in Table 7.

TABLE 6

Comparison of Results with Alkylhydroxamic Acid Using Plant Water and Tap Water for Coarse Feed (16 × 35, single stage flotation, alkylhydroxamic acid 1000 g/t)

| Test Water | Product | Wt. % | $P_2O_5$ % | $P_2O_5$ Recovery % |
|---|---|---|---|---|
| Tap | Concentrate | 27.56 | 30.23 | 91.57 |
| | Tailing | 72.44 | 1.06 | 8.34 |
| | Feed | 100.00 | 9.11 | 100.00 |
| Plant | Concentrate | 27.96 | 27.30 | 90.18 |
| | Tailing | 71.04 | 1.03 | 9.82 |
| | Feed | 100.00 | 8.47 | 100.00 |

TABLE 7

Comparison of Results with Alkylhydroxamic Acid Using Plant Water and Tap Water for Fine Feed (35 × 150, single stage flotation, alkylhydroxamic acid 800 g/t)

| Test Water | Product | Wt. % | $P_2O_5$ % | $P_2O_5$ Recovery % |
|---|---|---|---|---|
| Tap | Concentrate | 11.36 | 29.10 | 85.42 |
| | Tailing | 88.64 | 0.64 | 14.58 |
| | Feed | 100.00 | 3.87 | 100.00 |
| Plant | Concentrate | 10.68 | 30.14 | 85.11 |
| | Tailing | 89.32 | 0.63 | 14.89 |
| | Feed | 100.00 | 3.78 | 100.00 |

Results from Tables 6 and 7 indicate that there is no significant difference in flotation efficiency when using tap or plant water with the alkylhydroxamic acid.

Alkylhydroxamic Acid Compared to Fatty Acid/Fuel Oil at the University of Utah

Results from comparison tests at the University of Utah using the alkylhydroxamic acid (HC) and fatty acid/fuel oil are presented for coarse feed in Table 8 and for fine feed in Table 9.

TABLE 8

Evaluation of the Alkylhydroxamic Acid vs. Fatty Acid/Fuel Oil for Coarse Feed from Florida (16 × 35, single stage flotation, collector 1000 g/t, tap water)

| Collector | Product | Wt. % | $P_2O_5$ % | $P_2O_5$ Recovery % |
|---|---|---|---|---|
| FA/FO | Concentrate | 34.21 | 21.83 | 89.94 |
| | Tailing | 65.79 | 1.27 | 10.06 |
| | Feed | 100.00 | 8.30 | 100.00 |
| HC | Concentrate | 27.56 | 30.23 | 91.57 |
| | Tailing | 72.44 | 1.06 | 8.34 |
| | Feed | 100.00 | 9.11 | 100.00 |

TABLE 9

Evaluation of the Alkylhydroxamic Acid vs. Fatty Acid/Fuel Oil for Fine Feed from Florida (35 × 150, single stage flotation, collector 800 g/t, plant water)

| Collector | Product | Wt. % | $P_2O_5$ % | $P_2O_5$ Recovery % |
|---|---|---|---|---|
| FA/FO | Concentrate | 19.42 | 17.68 | 91.03 |
| | Tailing | 80.58 | 0.42 | 8.97 |
| | Feed | 100.00 | 3.77 | 100.00 |
| HC | Concentrate | 10.68 | 30.14 | 85.11 |
| | Tailing | 89.32 | 0.63 | 14.89 |
| | Feed | 100.00 | 3.78 | 100.00 |

It is evident from the results presented in Tables 8 and 9 that the alkylhydroxarnic acid exhibits a higher selectivity than the fatty acid/fuel oil traditionally used and on this basis it is expected that the double float process can be eliminated.

Evaluation of the Alkylhydroxamic Acid at FIPR Laboratories

Independent evaluation of the hydroxamate collector technology was accomplished at FIPR laboratories. The results from this campaign were achieved with samples of coarse flotation feed from the IMC-Agrico Four Comers Plant. Experiments were done by both U of U researchers and FIPR researchers as indicated.

The results for coarse feed as received using tap water are presented for both the alkylhydroxamic acid and fatty acid/fuel oil in Table 10. The selectivity of the alkylhydroxamic acid is quite evident when the results for the alkylhydroxamic acid are compared to the results using different fatty acid/fuel oil collectors. These results are particularly impressive when the low grade (5–6% $P_2O_5$) of the feed is considered.

TABLE 10

Test Results from Coarse Feed as Received with Alkylhydroxamic Acid Using Tap Water at FIPR Lab (16 × 35, single stage flotation, $Na_2CO_3$ 400 g/t, $Na_2SiO_3$ 400 g/t, pH 8.6)

| Collector | Product | Wt. % | $P_2O_5$ % | $P_2O_5$ Recovery % | Notes |
|---|---|---|---|---|---|
| HC 1251.6 g/t | Concentrate | 15.74 | 31.15 | 87.12 | Done by U of U Researchers at FIPR |
| | Tailing | 84.26 | 0.86 | 12.88 | |
| | Feed | 100.00 | 5.63 | 100.00 | |
| HC 1430.44 g/t | Concentrate | 16.74 | 31.34 | 91.57 | Repeat by FIPR Researchers at FIPR |
| | Tailing | 83.26 | 0.58 | 8.43 | |
| | Feed | 100.00 | 5.73 | 100.00 | |
| FA/FO | Concentrate | 26.32 | 20.31 | 97.58 | Done by FIPR Researchers at FIPR |
| | Tailing | 73.68 | 0.18 | 2.42 | |
| | Feed | 100.00 | 5.47 | 100.00 | |
| Cotton Seed Soap | Concentrate | 39.53 | 13.96 | 96.71 | Done by FIPR Researchers at FIPR |
| | Tailing | 60.47 | 0.31 | 3.29 | |
| | Feed | 100.00 | 5.71 | 100.00 | |

Significant improvement is realized with deslimed coarse feed as indicated in Table 11.In these experiments the high quality concentrate 31% $P_2O_5$ was achieved at a recovery exceeding 95% in a single stage.

TABLE 11

Test Results from Deslimed Coarse Feed with Alkylhydroxamic Acid Using Tap Water at FIPR Lab (16 × 35, single stage flotation, $Na_2CO_3$ 400 g/t, $Na_2SiO_3$ 400 g/t, pH 8.6)

| Collector | Product | Wt. % | $P_2O_5$ % | $P_2O_5$ Recovery % | Notes |
|---|---|---|---|---|---|
| HC 1251.6 g/t | Concentrate | 17.32 | 31.12 | 95.18 | Done by U of U Researchers at FIPR |
| | Tailing | 82.68 | 0.33 | 4.82 | |
| | Feed | 100.00 | 5.66 | 100.00 | |
| HC 1323.15 g/t | Concentrate | 18.63 | 29.31 | 95.58 | Repeat by FIPR Researchers at FIPR |
| | Tailing | 81.37 | 0.31 | 4.42 | |
| | Feed | 100.00 | 5.71 | 100.00 | |

The issue of plant water was considered next and these results are presented in Table 12 for coarse feed as received and in Table 13 for deslimed coarse feed. The influence of plant water on the effectiveness of the alkylhydroxamic acid does not seem to be significant.

TABLE 12

Test Results from Coarse Feed as Received with Alkylhydroxamic Acid Using Plant Water at FIPR Lab (16 × 35, single stage flotation, $Na_2CO_3$ 400 g/t, $Na_2SiO_3$ 400 g/t, pH 8.6)

| Collector | Product | Wt. % | $P_2O_5$ % | $P_2O_5$ Recovery % | Notes |
|---|---|---|---|---|---|
| HC 1430.44 g/t | Concentrate | 17.01 | 31.42 | 93.88 | Done by U of U Researchers at FIPR |
| | Tailing | 82.99 | 0.42 | 6.12 | |
| | Feed | 100.00 | 5.69 | 100.00 | |
| HC-FO 1251.6 g/t | Concentrate | 16.15 | 31.94 | 90.71 | Done by U of U Researchers at FIPR |
| | Tailing | 83.85 | 0.63 | 9.29 | |
| | Feed | 100.00 | 5.68 | 100.00 | |

TABLE 13

Test Results from Deslimed Coarse Feed with Alkylhydroxamic Acid Using Plant Water at FIPR Lab (16 × 35, single stage flotation, $Na_2CO_3$ 400 g/t, $Na_2SiO_3$ 400 g/t, pH 8.6)

| Collector | Product | Wt. % | $P_2O_5$ % | $P_2O_5$ Recovery % | Notes |
|---|---|---|---|---|---|
| HC 1251.6 g/t | Concentrate | 17.39 | 31.02 | 94.36 | Done by U of U Researchers at FIPR |
| | Tailing | 82.61 | 0.39 | 5.64 | |
| | Feed | 100.00 | 5.71 | 100.00 | |

The flotation results as established in collaboration with independent researchers at FIPR laboratories for coarse feed indicate that a 91–95% single stage recovery can be achieved with a concentrate grade of >31% $P_2O_5$ using the alkylhydroxamic acid. These results are significantly better than those achieved using fatty acid/fuel oil as indicated in Table 8.

Summary

The effectiveness of the alkylhydroxamic acid has been evaluated with plant water both at the University of Utah and at FIPR. In both instances the use of plant water did not significantly influence the effectiveness of the alkylhydroxamic acid.

Next, the effectiveness of the alkylhydroxamic acid was compared to traditional fatty acid/fuel oil and the experimental results both at the U of U laboratories and at FIPR laboratories indicate that the alkylhydroxamic acid is significantly superior showing much greater selectivity in single stage phosphate flotation.

Finally, the effectiveness of the hydroxamate collector was established with independent evaluation at FIPR.

Figure 6:
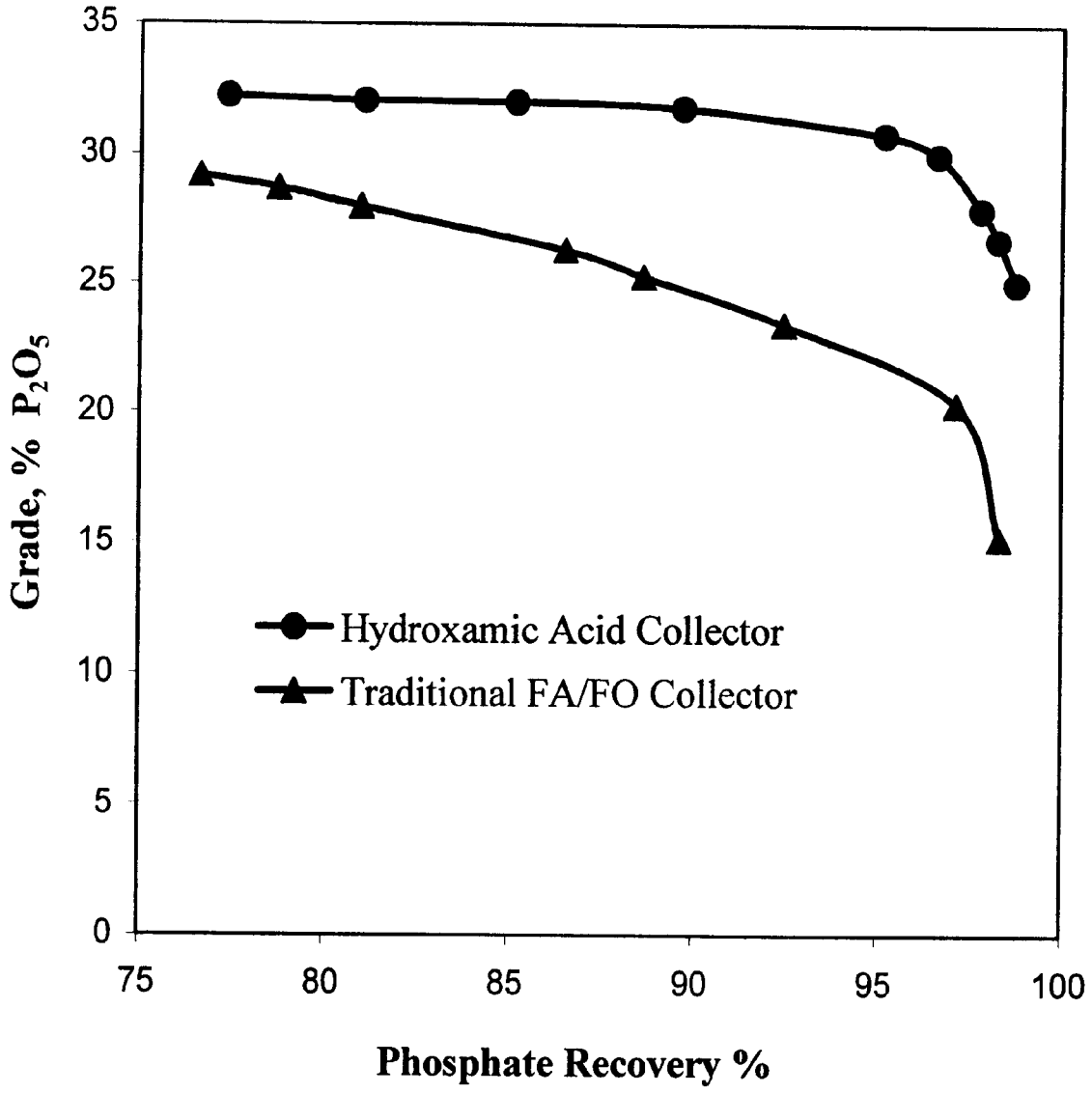
FIG. 6 is a graph that compares the grade/recovery curves obtained for the hydroxamic acid collector with traditional FA/FO collector for Florida coarse feed (16×35 mesh, 5.65% $P_2O_5$).

Experimental results which compare the flotation efficiency of the alkylhydroxamic acid with that of the traditional fatty acid/fuel oil collector are shown in FIG. 6. Florida coarse feed (16×35 mesh, 5.65% $P_2O_5$) was used.

Collectors of Hydroxamate and Alcohol

Figure 7:
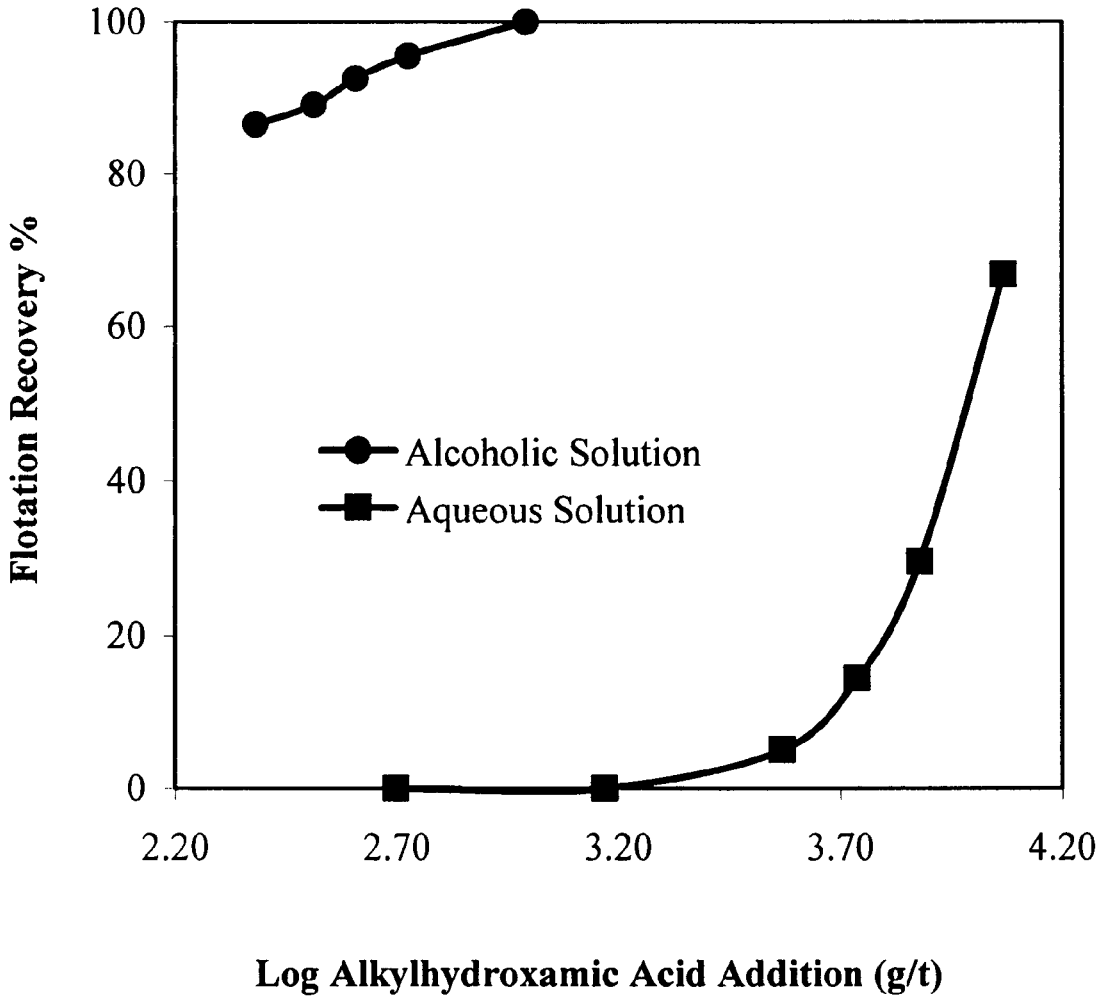
FIG. 7 is a graph showing francolite recovery as a function of alkylhydroxamic acid (AHA) addition for microflotation at a natural pH of 6.5 with and without alcohol addition.

In the preferred practice of the invention, the collector comprises a hydroxamate and an alcohol. The presence of alcohol enhances recovery. In the absence of alcohol, the recovery is modest but still practical. However, with the addition of alcohol, excellent separations are possible, as shown in FIG. 7. Nevertheless, it is important to note that no phosphate recovery can be achieved when alcohol is used alone.

Figure 8:
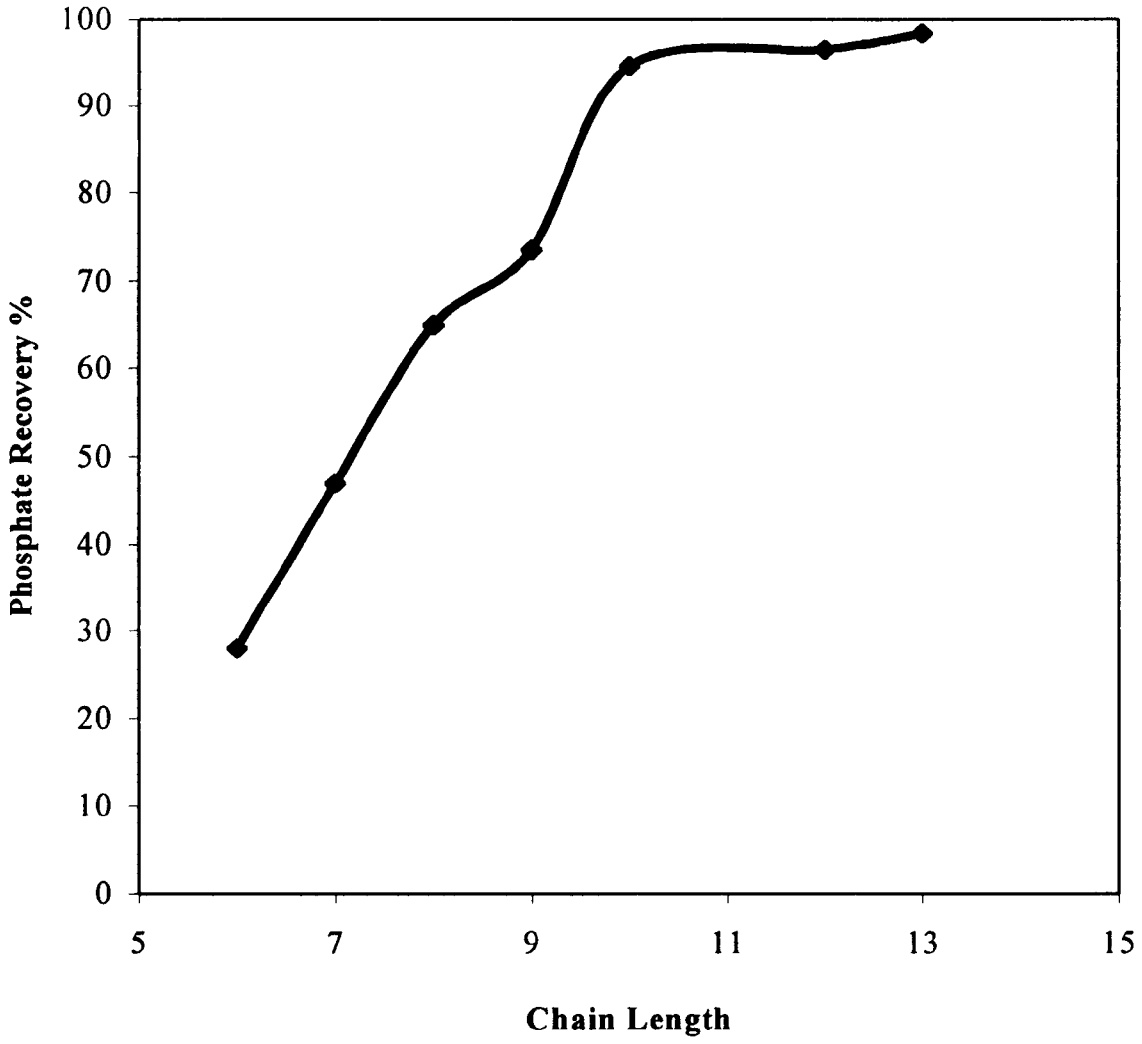
FIG. 8 is a graph showing flotation recovery as a function of the alcohol hydrocarbon chain length at a collector dosage 654 g/t (15% AHA and 85% ROH) for Florida coarse phosphate feed.

Flotation experiments with different compositions of the collector of the invention comprising hydroxamate and alcohol were made by varying the chain length of the alcohol. In FIG. 8 is shown the results of these experiments with alkylhydroxamic acids of different composition, showing the effect of the alcohol-hydrocarbon chain length on recovery. The collector dosage was 654 g/t (15% AHA and 85% ROH) for Florida coarse phosphate feed.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A method for separating phosphate minerals from a mineral mixture comprising;

conditioning the mineral mixture by contacting the mineral mixture in an aqueous environment with a collector in an amount sufficient to promote flotation of phosphate minerals, the collector comprising a hydroxamate compound and an alcohol, the hydroxamate compound of the formula,

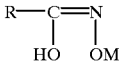

the alcohol of the formula, where R and R' are the same or different and are at least one of alkyl, aryl, or alkylaryl having 6 to 18 carbon atoms, and M is at least one of hydrogen, alkali metal or alkaline earth metal, subjecting the mineral mixture to flotation conditions to selectively float the phosphate minerals from the mineral mixture.

2. A method for separating phosphate minerals from a mineral mixture as in claim 1 wherein the conditioning comprises contacting the mineral mixture with the collector at a solids content between 70 and 75 weight percent solids, which mineral mixture is subsequently diluted with water before the subjecting of the mineral mixture to flotation conditions.

* * * * *